United States Patent [19]

Ashida

[11] Patent Number: 4,870,001

[45] Date of Patent: Sep. 26, 1989

[54] SILVER HALIDE PHOTOGRAPHIC PAPER HAVING DEVELOPER IN THE EMULSION LAYER AND A ROUGH HYDROPHILIC BACKCOATING LAYER

[75] Inventor: Tetsuya Ashida, Tokyo, Japan

[73] Assignee: Mitsubishi Paper Mills, Ltd., Tokyo, Japan

[21] Appl. No.: 267,674

[22] Filed: Oct. 26, 1988

Related U.S. Application Data

[63] Continuation of Ser. No. 943,770, Dec. 19, 1986, abandoned.

[30] Foreign Application Priority Data

Dec. 24, 1985 [JP] Japan ..... 60-296464

[51] Int. Cl.[4] ..... G03C 1/76

[52] U.S. Cl. ..... 430/538; 430/496; 430/537; 430/950

[58] Field of Search ..... 430/537, 538, 496, 950

[56] References Cited

U.S. PATENT DOCUMENTS

| | | | |
|---|---|---|---|
| 4,168,979 | 9/1979 | Ohishi et al. | 430/950 |
| 4,209,584 | 6/1980 | Joseph | 430/538 |
| 4,296,198 | 10/1981 | Trautweiler | 430/538 |
| 4,410,619 | 10/1983 | Kubbota et al. | 430/538 |
| 4,547,445 | 10/1985 | Asahina et al. | 430/538 |
| 4,548,894 | 10/1985 | Lynch et al. | 430/950 |
| 4,588,673 | 5/1986 | Kataoka et al. | 430/537 |
| 4,594,315 | 6/1986 | Shibue et al. | 430/538 |
| 4,610,924 | 9/1986 | Tamagawa et al. | 430/538 |
| 4,614,688 | 9/1986 | Tamagawa et al. | 430/538 |

*Primary Examiner*—Jack P. Brammer

*Attorney, Agent, or Firm*—Cushman, Darby & Cushman

[57] ABSTRACT

Blocking between emulsion layer and backcoating layer and haze of the emulsion surface which often occur when silver halide photographic papers are stored in the form of a roll or a stack can be avoided or reduced by providing a silver halide photographic paper comprising a support coated with a resin on both sides where the surface roughness of the resin layer provided on the side where emulsion layer is not present is within the range of 0.7–2.5 $\mu$ in terms of center line average height Ra according to JIS B0601. This effect is conspicuous in reduction of blocking and haze which severely occur in the photographic paper where the developer is contained in the photographic layer.

4 Claims, No Drawings

SILVER HALIDE PHOTOGRAPHIC PAPER HAVING DEVELOPER IN THE EMULSION LAYER AND A ROUGH HYDROPHILIC BACKCOATING LAYER

This is a continuation of application Ser. No. 06/943,770, filed Dec. 19, 1986, which was abandoned upon the filing hereof.

BACKGROUND OF THE INVENTION

This invention relates to a silver halide photographic paper and especially it relates to a silver halide photographic paper which includes a silver halide developing agent and has a hydrophilic colloid backcoating layer on the back side and which is free from blocking between the emulsion surface and the backcoating layer when stored in the form of a roll or a stack and is reduced in haze on the surface of the emulsion layer.

Hitherto, baryta paper has been used as a support for photographic paper, but recently, for the purpose of rapid photographic treatment there has been used a photographic paper coated with a water resistant resin on both sides. Photographic papers having such resin coated paper as a support have a mirror surface (smooth and gloss surface), a matte surface, or a silky surface in accordance with the state of the side to be coated with an emulsion (which will be called "front side" hereinafter). On the other hand, the side of a support which is opposite to the side to be coated with emulsion has a matte surface of various types (This side will be called "back side" hereinafter.).

When photographic papers having a front side of mirror-like surface are stored in the form of a roll or a stack, the emulsion surface of front side is kept in contact with back side. On the back side, there is usually provided a hydrophilic colloid layer, which often causes blocking with the emulsion surface. Especially, those photographic papers which contain silver halide developing agent in their emulsion layer for rapid development further tend to cause blocking because the developing agent hinders hardening of the emulsion layer. This tendency is further promoted when the photographic papers are heated by mill rolls after coating of emulsion layer. Those photographic papers which have suffered from blocking have streak-like haze (the state of lower gloss) on the surface to result in conspicuous reduction in commercial value as photographic paper. In an extreme case, the backcoating layer on the back side and the emulsion layer completely stick to each other and they cannot be separated from each other.

SUMMARY OF THE INVENTION

The object of this invention is to provide a silver halide photographic paper, especially containing a developing agent in photographic layer and provided with a backcoating layer comprising hydrophilic colloid on the back side which is free from blocking and is reduced in haze on the emulsion layer.

DESCRIPTION OF THE INVENTION

The above object of this invention has been accomplished by a silver halide photographic paper having a support coated with a resin on both sides wherein surface roughness of the back side is 0.7–2.5$\mu$ in terms of center line average height Ra as prescribed in JIS B0601 (Japanese Industrial Standard B0601).

Resin coated papers used in the silver halide photographic papers of this invention are usually produced by coating a resin on a traveling paper or synthetic paper base (referred to as "paper base" hereinafter).

The paper base used in this invention is mainly composed of natural pulp, but if necessary, there may be used base papers made by mixing synthetic pulp and synthetic fiber. The thickness of the paper base has no limitation, but preferably it has a smooth surface and a basis weight of 50 g/m$^2$–250 g/m$^2$.

The paper base mainly composed of natural pulp which is advantageously used in this invention may contain various polymer compounds and additives. For example, it may contain, in an appropriate combination, cationized starch, cationized polyacrylamide, anionized polyacrylamide, carboxy-modified polyvinyl alcohol, gelatin, etc. as a dry-strength increasing agent, fatty acid salts, rosin derivatives, dialkylketene dimer emulsion, petroleum emulsion, ammonium salts of styrene-maleic anhydride copolymer alkyl esters, etc. as a sizing agent, clay, kaolin, calcium carbonate, barium sulfate, titanium dioxide, etc. as a pigment, melamine resin, urea resin, epoxidized polyamide resin, etc. as a wet-strength increasing agent, polyvalent metal salts such as aluminum sulfate, aluminum chloride, etc. and cationic polymers such as cationized starch as a fixing agent; sodium hydroxide, sodium carbonate, hydrochloric acid, etc. as a pH regulater; and sodium chloride, Glauber's salt, etc. as an inorganic electrolyte.

The resin is melt-extrusion coated on a paper base. Roughening is carried out simultaneously with coating by a roll which also serves as a cooling roll.

As the coating resins, polyethylene is most commonly used, but any thermoplastic resins may be used so long as they do not damage the photographic emulsion.

The resins may contain a white pigment such as titanium oxide, a colorant, an electric conducting agent, a stabilizer, etc.

The resin coated papers used in this invention are generally subjected to corona discharge treatment and a backcoating layer comprising a hydrophilic organic or inorganic colloid is provided on the back side to impart antistatic property. The hydrophilic organic or inorganic colloids used in this invention include gelatin, polyvinyl alcohol, starch, colloidal silica, colloidal alumina, etc., but they are never limited to these colloids. Furthermore, a subbing layer may be provided on the front side.

The surface states of the front side of the present photographic papers are, like that of the support, gloss surface, matte surface, silky surface, etc. and the effect of this invention is most highly exhibited when the surface of the front side is a gloss surface.

The surface state of resin layer on the back side of the present photographic paper is ordinarily a matte surface. The method for roughening the resin layer of the back side and the roughness thereof are explained below. Methods for making a roll having a matte surface for matting the resin layer of the back side include embossing method, etching method, dry sandblasting method, liquid honing method, etc. The effect of this invention can be obtained by using photographic papers having back side subjected to matting treatment by rolls made by any of these methods, especially effective are those photographic papers having a back side subjected to a matting treatment by the rolls made by the liquid honing method.

When the surface roughness of the resin layer on the back side is less than 0.7μ in terms of the center line average height Ra as prescribed in JIS B0601, the contacting area of the emulsion surface and the surface of the back side is large when the photographic papers are stored in the form of a roll or a stack and blocking is apt to occur between the emulsion surface and the surface of back side. There is no great difference in this tendency depending on the method used for making the rolls.

When the surface roughness of resin layer on the back side of photographic papers is more than 2.5μ in terms of the center line average height Ra, the blocking decreases, but the patterns of the back side are transferred to the emulsion surface, which is a cause of haze.

From the above, the surface roughness of the resin layer on the back side should be within the range of 0.7–2.5μ in terms of center line average height Ra as prescribed in JIS B0601 and the effect of this invention can be fully recognized in case of heating by mill roll which usually promotes occurrence of blocking.

Various silver halide emulsions can be advantageously used in silver halide photographic layer. For example, these emulsion may have the silver halide compositions such as silver chloride, silver bromide, silver chlorobromide, silver chloroiodobromide, silver iodochloride, silver iodobromide, etc. or mixtures thereof. From the point of crystalline form or crystal habit of silver halide, they may comprise regular form grains such as cubic grains or irregular grains of twin structure and furthermore, they may comprise grains having [1, 1, 1] plane, [1, 0, 0] plane and the like or mixed crystal grains, e.g., those having [1, 1, 1] and [1, 0, 0] planes. They may comprise fine grains or coarse grains and have a narrow grain size distribution. Furthermore, emulsions may have a pH of, for example, 4.0–8.0 and a silver ion concentration of, for example, PAg 6.0–11.0. As binders for silver halide grains there may be used gelatin or synthetic hydrophilic binders such as polymers, e.g., polyvinyl alcohol, poly-N-vinylpyrrolidone, acrylic acid-acrylic ester-acrylamide copolymer, etc. Negative type silver halide emulsions may also be used. If necessary, direct positive type silver halide emulsions may also be used. Moreover, there may also be used surface latent image type silver halide emulsions which form a latent image mainly on the surface of silver halide grains or internal latent image type silver halide emulsions.

Furthermore, silver halide emulsions prepared by carrying out formation and dispersion of silver halide crystals and the first ripening by various processes and under various conditions can be used in this invention. For example, they may be prepared by regular mixing method, reversal mixing method, simultaneous mixing methods (double-jet method, multi-jet method), silver halide conversion method disclosed in Japanese Patent Examined Publication (Kokoku) No. 7772/71, U.S. Pat. No. 2,592,520, etc., ammoniacal method, acid method, neutral method, silver iodide nucleation method disclosed in Japanese Patent Unexamined Publication (Kokai) No. 65925/73 and combination of these methods. Especially suitable are those which contain various additives added during formation and dispersion and the first ripening or after the first ripening. Examples of these additives are water soluble rhodium compounds such as rhodium trichloride, hexahalogenorhodates, etc., hexahalogenoiridates such as hexahalogenoiridates [III], hexahalogenoiridate [IV], etc, water soluble iridium compounds such as iridium chloride (III), iridium bromide (III), etc., water soluble gold compounds such as gold halides, aurates, gold halide hydroacid or salts thereof, mercapto-heterocyclic compounds disclosed in Japanese Patent Unexamined Publication Nos. 149725/75 and 107129/76, hydroxyazaindolidine compounds disclosed in Japanese Patent Unexamined Publication No. 103018/79, water soluble inorganic or organic salts of zinc, lithium, nickel, etc, or combinations of these compounds. These silver halide photographic emulsions which have been subjected to the first ripening are subjected to precipitation and dehydration and preferably washing with water until desired electrical conductance and silver ion concentration are reached, but the washing with water may be omitted.

These silver halide photographic emulsions are normally subjected to various chemical sensitization before use. The emulsions advantageously usable in this invention are those which are subjected to such chemical sensitizations as, for example, sulfur sensitizations with sensitizing gelatin containing active sulfur compounds, thiosulfates, active sulfur compounds, seleno sensitizations with seleno compounds such as N,N-dimethylselenourea, noble metal sensitizations with water soluble noble metal compounds such as iridium, gold, platinum, etc., sensitizations with polyethylene oxide derivatives, etc.

Further, the emulsions are advantageously subjected to spectral sensitization or super sensitization with one or more of polymethine sensitizing dyes such as cyanine, merocyanine, carbocyanine, etc. or combination thereof with styryl dyes.

Silver halide color photographic emulsions may also be used in this invention. That is, there may also be used the emulsions which contain a compound (coupler) which reacts with an oxidation product of a developing agent to form a dye. As representative couplers usable for this purpose, mention may be made of pivaloylacetoanilide type or benzoylacetoanilide type open chain ketomethylene yellow coupler, pyrazolone magenta coupler, phenol or naphthol cyan coupler, mixtures thereof and black coupler. Depending on the structure of these couplers, mention may be made of development inhibiter releasing type couplers (DIR couplers), two equivalent couplers where -o-allyl substitution, -o-acyl substitution, hydantoin compound substitution, urazol compound substitution, succinimide compound substitution, monooxoimide compound substitution, pyridazone compound substitution, etc. are made at active centre.

Various binders and protective colloids may be used in the photographic layers provided in the practice of this invention. That is, there may be used lime treated gelatin, acid treated gelatin, gelatin derivatives such as phthalated gelatin, acylated gelatin, etc., starch and its derivatives, cellulose compounds such as carboxymethyl cellulose, hydroxyethyl cellulose, etc., synthetic hydrophilic binders such as polyvinyl alcohol, poly-N-vinylpyrrolidone, acrylic acid-acrylic ester copolymer, acrylic acid-acrylamide copolymer, acrylic acid-acrylic ester-acrylamide copolymer, etc. As viscosity increasing agent for gelatin and gelatin derivatives, there may be used, for example, natural or synthetic high molecular materials having hydroxyl group such as celluloses, dextrin, dextran, alginic acid, starch, polyvinyl alcohol, etc., preferably sulfuric esters of polysaccharides, polymers such as styrenemaleic acid copolymer, alkylvinyl ether-maleic acid copolymer, etc. alone or in combination.

Advantageously, antifoggant or stabilizer is contained in photographic layer provided for practice of this invention, preferably a silver halide emulsion layer. For example, there may be advantageously contained alone or in combination hydroxy-azaindolidine compounds disclosed in U.S. Pat. Nos. 2,716,062, 2,944,900 etc., mercapto-heterocyclic compounds, disclosed in Japanese Patent Unexamined Publication Nos. 102621/73, 107129/76, etc., heterocyclic compounds containing no mercapto group such as 2-thion heterocyclic compounds, benzimidazole, benzotriazole, 1-phenyl-tetrazole, benzoxazole, guanazole compounds, etc.

Furthermore, various additives may be contained in the photographic layers provided in this invention. For example, there may be contained organic hardeners such as formalin, reaction products of formaldehyde with urea or melamine, halogenocarboxylic acids, vinyl sulfone compounds, aziridine compounds, epoxy compounds, active halogen compounds, acryloyl compounds, isocyanate compounds, etc. and inorganic hardeners such as chrome alum, zirconium carbonate, etc., anionic surface active agents such as alkylbenzenesulfonates, sulfosuccinates, etc., nonionic surface active agents such as saponin, alkylene oxide compounds, etc., ampholytic surface active agents such as amino acids, aminosulfonic acids, esters of aminoalcohol, etc., ultraviolet light absorbers such as benzotriazole compounds having hydroxydialkylphenyl group at 2-position, fluorescent brighteners such as those compounds as disclosed in Japanese Patent Examined Publication (Kokoku) No. 24068/70 and Japanese Patent Unexamined Publication (Kokai) No. 94318/79, sharpness increasing dyes such as food dye Red No. 2, acid dyes disclosed in Japanese Patent Unexamined Publication (Kokai) No. 14721/72, sequestering agents such as ethylenediaminetetraacetate, etc., mordants such as N-guanylhydrazine, quaternary onium salts, etc., antistatic agents such as cellulose type antistatic agents, alkali salts of polystyrene-sulfonic acid, alkali salts of polymerized acrylic acids and acrylic acid copolymers, etc., matting agents such as polymethyl methacrylate, polystyrene, methacrylic acid-methacrylate copolymer, colloidal silicon oxide, etc., film property improvers such as latexes comprising copolymers of acrylates, methacrylates etc. with other monomers having ethylene group. Furthermore, the image receiving layer for diffusion transfer process according to this invention may contain development nuclei for silver halide complexes which are suitable for acceleration of formation of silver-containing diffusion transfer images. Examples of the development nuclei are sulfides of noble metals such as silver, gold, platinum, palladium, etc., sulfides of heavy metals such as antimony, bismuth, cobalt, nickel, zinc, etc., fogged silver halides, etc. and especially preferred are colloidal sulfides of noble metals. Moreover, direct positive silver halide emulsion layer according to this invention may contain additives for direct positive photographic emulsion such as fogging agent, sensitizing dyes for direct positive emulsions.

The effect of this invention is especially markedly exhibited in the silver halide photographic paper where the silver halide photographic layer contains silver halide developing agent.

The silver halide developer used in this invention means compounds capable of developing silver halide by treatment with development activators, e.g., an alkaline solution and includes silver halide developing agent and precursor for developing agent. As examples of the silver halide developing agent, mention may be made of hydroquinone compounds such as hydroquinone, 2-methylhydroquinone, 2,5-dimethylhydroquinone, trimethylhydroquinone, 2-chloro-hydroquinone, 2-phenylhydroquinone, 2-tert-butylhydroquinone, 2,5-di-tert-butylhydroquinone, 2,5-di-tert-octylhydroquinone, etc.; polyhydric phenol compounds such as catechol, 4-tert-butyl-catechol, pyrogallol, etc.; 3-pyrazolidone compounds such as 1-phenyl-3-pyrazolidone (phenidone), 1-(m-tolyl)-3-pyrazolidone, 1-phenyl-2-acetyl-3-pyrazolidone, 1-phenyl-4-methyl-3-pyrazolidone, 1-phenyl-4,4-dimethyl-3-pyrazolidone, 1-phenyl-4-methyl-4-hydroxymethyl-3-pyrazolidone, 1-p-chlorophenyl-4-methyl-4-hydroxy-3-pyrazolidone, 1-(p-tolyl)-4,4-dihydroxymethyl-3-pyrazolidone, 1-phenyl-4-hydroxymethyl-3-pyrazolidone etc.; aminophenol compounds such as p-aminophenol, 2-amino-4-methyl-phenol, Metol, 4-hydroxyphenylaminoacetic acid, etc.; aminohexose reductone compounds such as dimethylaminohexose reductone, di-n-butylaminohexose reductone, morpholinohexose reductone, pyrazinohexose reductone, etc.; aminonaphthalene diol compounds such as 4-amino-1,4-dihydroxynaphthalene, 2-amino-1,5-dihydroxynaphthalene, etc.; 4-aminoaniline compounds such as p-phenylenediamine, 4-(N,N-diethyl)aminoaniline, 4-(N-ethyl-N-hydroxyethyl)aminoaniline, 4-(N-ethyl-N-β-methylsulfoneaminoethyl) amino-2-methylaniline, 4-(N-ethyl-N-hydroxyethyl)amino-2-methylaniline, etc. and their hydrochlorides, sulfates, tetraphenylboron salts, etc., hydrazine, hydroxylamine, naphthalene diol, etc. As examples of the developing agent precursors, mention may be made of 4-chloroacetyloxy-hydroquinone, hydroquinone monoacetate 1,4-dichloroacetyloxyhydroquinone, 1,4-diacetyloxyhydroquinone, catechol monobenzoate, 2-methylhydroquinone monoacetate, hydroquinone monobenzoate, 2-methoxyhydroquinone monobenzoate, etc. However, this invention is never limited to these silver halide developers. These silver halide developers may be contained alone or in combination. For example, use of a hydroquinone compound and a 3-pyrazolidone compound in combination is useful.

The silver halide developers used in this invention may be contained in at least one of the photographic layers comprising silver halide emulsion layer, a protective layer, a subbing layer, an intermediate layer, anticontaminating layer, antihalation layer, antibogging layer or a filter layer or combination thereof provided on a support, but considering the developing efficiency, it is especially advantageous to contain the developer in the silver halide emulsion layer and if necessary, it may also be contained in other layers in addition to the emulsion layer. It is also possible to contain the developer in only the photographic layer other than the emulsion layer. Furthermore, in case of specific photographic materials, for example, those for diffusion transfer process, there may be contained, e.g., 3-pyrazolidone compound in the photographic layer of silver halide photographic material and e.g., a hydroquinone compound in the photographic layer of an image receiving material. In order to contain the silver halide developer in the photographic layer, it is advantageous to add the developer to a hydrophilic colloid coating composition for formation of the photographic layer during the preparation of photographic materials. For the addition of the developer, there are the method of adding to a coating composition for photographic layer a solution of the developer in a solvent such as water, methanol, ethanol, propanol, isopropanol, acetone, methyl ethyl ketone, benzene, dioxane or the like, the method which comprises dissolving the developer in a high boiling solvent such as dibutyl phthalate, di-n-nonyl phthalate, tricresyl phosphate or the like or, if necessary, in a mixed solvent with a low boiling solvent such as ethyl acetate, cyclohexane or the like, then emulsifying the solution in a hydrophilic colloid solution in the presence of a surface active agent and adding this emulsion to a coating composition for photographic layer (called oil protect method), the method of occluding a solution of the developer in a low boiling solvent in a resin latex and adding the latex to a coating composition for photographic layer (called resin latex method), etc.

Content of the silver halide developer in photographic layer is preferably 0.1 g/m$^2$–2.0 g/m$^2$, especially preferably 0.25 g/m$^2$–1.25 g/m$^2$. When the content is less than 0.1 g/m$^2$, action as a developer is not sufficiently exhibited and when more than 2.0 g/m$^2$, there are brought about photographic problems and besides this is economically unfavorable.

The following examples illustrate this invention.

EXAMPLES

A mixture of 50 parts by weight of bleached kraft pulp of broad-leaved trees and 50 parts by weight of bleached sulfite pulp of needle-leaf trees was beaten to a Canadian Standard Freeness of 310 ml and a paper of 150 g/m$^2$ was made from the following formulation. The numerical values in the formulation are part by weight.

| | |
|---|---|
| Pulp | 100 |
| Cationized starch | 2 |
| Anionic polyacrylamide resin | 0.5 |
| Sodium stearate | 0.5 |
| Aluminum sulfate pH was adjusted to | 4.5 |
| Alkyl ketene dimer emulsifier (as ketene dimer) | 0.4 |
| Polyamide polyamine epichlorohydrin resin | 0.4 |

Thus obtained wet paper was dried by a heating plate of 110° C.

This paper was impregnated with 30 g/m$^2$ of an impregnating solution of the following formulation and dried by a hot-air constant temperature drier at 110° C.

| | Part by weight |
|---|---|
| Gelatin | 3 |
| Diaminostilbenedisulfonate fluorescent brightener | 0.05 |
| Blue dye | 0.002 |
| Water to make up 100 parts | 0.002 |

Thus impregnated and dried paper base was subjected to super calender treatment at a linear pressure of 90 Kg/cm and then corona discharge treatment on both sides. Thereafter, the back side was coated with a 1:1 mixture of a high-density polyethylene (density=0.96 g/cm$^3$ and melt index=5) and a low density polyethylene (density=0.92 g/cm$^3$ and melt index=5) at a thickness of 20μ at a resin temperature of 330° C. by a melt extrusion coater. At the melt extrusion coating on the back side, the surface was subjected to roughening treatment by a cooling roll made by the methods as mentioned in Table 1 and having Ra as also mentioned in Table 1.

Subsequently, on the front side of the paper base was coated a low-density polyethylene containing 12% of anatase type titanium oxide (the polyethylene before addition of the pigment had a density of 0.92 g/cm$^3$ and an melt index of 5) at a thickness of 20μ at a resin temperature of 330° C.

Then, the back side was subjected to corona discharge treatment and thereafter coated with a backcoating solution of the following formulation and was dried. Coating amount was 3 g/m$^2$ (wet base).

| | Part by weight |
|---|---|
| Gelatin (manufactured by Nippi Co.) | 1 |
| Colloidal silica (Snowtex C manufactured by Nissan Chemical Co.) | 30 |
| NER 010 (manufactured by Nagase Co., Ltd.) | 0.1 |
| 5% aqueous solution of 2-ethylhexyl sodium sulfosuccinate | 0.5 |
| Water to make up 100 parts by weight | |

Then, the following emulsion was coated on the surface of the polyethylene containing titanium oxide which had been subjected to corona discharge treatment and was dried.

In the presence of $6\times10^{-6}$ g of potassium hexachlororhodanate (III), 19.2 g of silver halide grains were formed and dispersed in 14.4 g of gelatin to produce an acid method silver halide photographic emulsion which had a halogen composition of AgBr/AgCl=45/55 and an average grain size of 0.6μ, was sulfur sensitized to the maximum sensitivity and comprised substantially [1, 0, 0] plane. This emulsion was dissolved in 420 g of 8% aqueous gelatin solution. To this solution were added 6.4 cc of 0.1% solution of the sensitizing dye [II] represented by the following general formula in N,N-dimethylformamide:

[II]

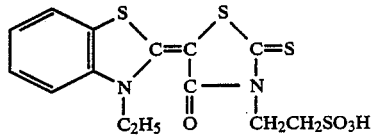

, 0.48 cc of 1% methanolic solution of 1-phenyl-5-mercapto-tetrazole and 0.48 cc of 1% methanolic solution of 1-benzoylamino-2-phenyl-5-mercapto-triazole and then were further added 10 cc of 10% sodium dodecylbenzenesulfonate, 20 cc of 1% aqueous solution of a substituted diaminostilbenedisulfonate type fluorescent brightener and 16 cc of a 12% aqueous solution of 2,4-dichloro-6-hydroxy-S-triazine. To the resulting mixture was added a solution prepared by dissolving 0 g (0 g/m$^2$), 0.8 g (0.1 g/m$^2$), 4 g (0.5 g/m$^2$) and 8 g (1.0 g/m$^2$) of methylhydroquinone in isopropyl alcohol, respectively as a silver halide developer to produce four emulsions. The pH of these emulsions was adjusted to 4.6 with a pH regulater and water was added to make up 600 g. These emulsions were coated on the above coated polyethylene containing titanium oxide layer at a coating amount of 75 g/m$^2$ (wet base) with an emulsion protective solution prepared as explained below.

30 g of gelatin was dissolved in 300 cc of water and to the resulting solution were added 6.8 cc of 10% sodium dodecylbenzenesulfonate and 18 cc of 12% aqueous solution of 2,4-dichloro-6-hydroxy-S-triazine and was further added water to make up 400 g. This solution was coated on the emulsion layer as a protective layer at a coating amount of 40 g/m$^2$ (wet base).

These samples dried were warmed by a mill roll at 40° C. and 65% RH for 5 days in the form of a roll and these rolls were employed as test samples.

Degree of blocking was evaluated by measuring the force required for separating the emulsion layer and the backcoating layer. Specifically, a sample of 5 cm in length of flow direction and 1 cm in width was cut out from the sample in the form of roll without separating the emulsion layer and the backcoating layer. This sample was set to the measuring chuck of Tensilon CR-7000 manufactured by Toyo Baldwin Co., Ltd. and the chuck was dropped at a falling rate of 2 cm/min. and the force applied to a load cell was recorded by a recorder. After completion of measurement, the values were read and expressed as peeling strength for 1 cm width. The lower values indicate less blocking.

Evaluation of haze was carried out by obliquely projecting a light onto the surface of the emulsion layer of the samples which had been subjected to evaluation of blocking and observing from diametrically opposite side and direction with the naked eye. The state of haze was classified to the following four grades.

A: No haze is seen.

B: A little haze is seen, but this can be ignored.

C: There occurs a haze which is well recognized.

D: A heavy haze occurs.

Samples of grades A and B are satisfactory in practical use.

It will be recognized from Table 1 that samples which are satisfactory in both the blocking and haze are only those samples which have a surface roughness of back side is 0.7–2.5μ in terms of Ra regardless of rolls used.

For reference, samples (containing no developer) which were same as above except that the backcoating layer was not provided were made and degree of blocking and haze thereof are shown in Table 3. As is clear from these results, samples having no back coating layer are satisfactory in both the degree of blocking and haze and have no problems to be solved by this invention.

TABLE 1

| Sample No. | Method of making roll | Ra |
|---|---|---|
| 1 (Comparative Example) | Dry sandblasting method | 0.32 |
| 2 (Comparative Example) | " | 0.55 |
| 3 (Example) | " | 0.72 |
| 4 (Example) | " | 2.33 |
| 5 (Comparative Example) | " | 2.87 |
| 6 (Comparative Example) | Liquid honing method | 0.50 |
| 7 (Example) | " | 0.88 |
| 8 (Example) | Embossing method | 1.18 |
| 9 (Example) | Etching method | 1.25 |

TABLE 2

| Amount of silver halide developer added | | Sample No. 1 | 2 | 3 | 4 | 5 | 6 | 7 | 8 | 9 |
|---|---|---|---|---|---|---|---|---|---|---|
| 0 g/m$^2$ | Blocking | 100 | 70 | 15 | 10 | 10 > | 40 | 10 > | 15 | 15 |
| | Haze | C | C | A | A | C | B | A | A | A |
| 0.1 g/m$^2$ | Blocking | 140 | 100 | 25 | 15 | 10 > | 75 | 10 > | 20 | 25 |
| | Haze | D | C | A | A | D | C | A | A | A |
| 0.5 g/m$^2$ | Blocking | 280 | 200 | 35 | 20 | 10 > | 145 | 10 | 55 | 10 |
| | Haze | D | D | B | A | D | C | A | B | B |
| 1.0 g/m$^2$ | Blocking | 600 | 390 | 55 | 30 | 10 | 200 | 10 | 80 | 90 |
| | Haze | D | D | B | A | D | D | A | B | B |
| | | Comparative Example | Comparative Example | This invention | This invention | Comparative Example | Comparative Example | This invention | This invention | This invention |

TABLE 3

| Amount of developer added | | Sample No. 1 | 2 | 3 | 4 | 5 | 6 | 7 | 8 | 9 |
|---|---|---|---|---|---|---|---|---|---|---|
| 0 g/m$^2$ | Blocking | 15 | 10 | 10 > | 10 > | 10 > | 10 | 10 > | 10 > | 10 > |
| | Haze | B | B | A | A | B | B | A | A | A |

What is claimed is:

1. A silver halide photographic paper which comprises:

(a) a support having polyethylene layers on both sides, (b) photographic layers including (i) a silver halide emulsion layer on one of said polyethylene layers; said silver halide emulsion layer containing a silver halide developer having been coated thereon during the process for forming said photographic layers so as to rapidly develop an image when contacted with development activators, and (ii) a backcoating layer comprising a hydrophilic colloid on the other polyethylene layer having a surface roughness of 0.7–2.5 μm in terms of center line average height Ra as prescribed in JIS B0601; said surface roughness being provided by subjecting said layer to a matting treatment using rolls.

2. A silver halide photographic paper according to claim 1 wherein said hydrophilic colloid of the backcoat layer is used as a binder.

3. A silver halide photographic paper according to claim 1 wherein the amount of the silver halide developer is 0.1 g/m$^2$–2 g/m$^2$.

4. A silver halide photographic paper according to claim 1 which is heated by mill roll.

* * * * *